US007246856B2

(12) United States Patent
Kruse et al.

(10) Patent No.: US 7,246,856 B2
(45) Date of Patent: Jul. 24, 2007

(54) SEAT POSITIONING AND CONTROL SYSTEM

(75) Inventors: Thomas Kruse, Sarasota, FL (US); Timothy Philipp, Riverview, FL (US)

(73) Assignee: Hoveround Corporation, Sarasota, FL (US)

( * ) Notice: Subject to any disclaimer, the term of this patent is extended or adjusted under 35 U.S.C. 154(b) by 545 days.

(21) Appl. No.: 10/729,775

(22) Filed: Dec. 5, 2003

(65) Prior Publication Data

US 2005/0121959 A1 Jun. 9, 2005

(51) Int. Cl.
*A61G 15/02* (2006.01)
*A61G 15/04* (2006.01)
*A61G 15/06* (2006.01)

(52) U.S. Cl. ..... 297/330; 297/DIG. 4

(58) Field of Classification Search ..... 297/330, 297/DIG. 4

See application file for complete search history.

(56) References Cited

U.S. PATENT DOCUMENTS 4,278,290 A * 7/1981 Werner et al. ..... 297/330 X
4,421,336 A * 12/1983 Petrofsky et al. .. 297/DIG. 4 X
4,470,632 A * 9/1984 Babbs ..... 297/330 X
4,695,682 A * 9/1987 Winogrocki ..... 297/330 X
5,015,035 A * 5/1991 Stoeckl et al. ..... 297/330 X
5,163,734 A * 11/1992 Hakansson ..... 297/330
5,190,349 A * 3/1993 Austin et al. ..... 297/330 X
5,201,377 A * 4/1993 Wilson ..... 297/DIG. 4 X
5,214,360 A * 5/1993 Gonser et al. ..... 297/330 X
5,267,778 A * 12/1993 Krebs et al. ..... 297/330
5,340,953 A * 8/1994 Krebs et al. ..... 297/330 X
5,467,002 A * 11/1995 Brooks ..... 297/330 X
5,712,625 A * 1/1998 Murphy ..... 297/330 X
5,751,129 A * 5/1998 Vergin ..... 297/330
5,884,350 A * 3/1999 Kurze ..... 297/330 X
6,055,877 A * 5/2000 Welterlin et al. ..... 297/330 X
6,068,280 A * 5/2000 Torres ..... 297/330 X
6,119,980 A * 9/2000 Ferry ..... 297/330 X
6,425,635 B1 * 7/2002 Pulver ..... 297/330 X
6,492,786 B1 * 12/2002 Vang et al. ..... 297/330 X
6,731,088 B2 * 5/2004 Nivet ..... 297/330 X
6,752,463 B2 * 6/2004 Nivet ..... 297/330 X
6,794,841 B1 * 9/2004 Vang et al. ..... 297/330 X
6,874,855 B2 * 4/2005 Nivet ..... 297/330 X
2002/0113477 A1 * 8/2002 Uchiyama ..... 297/330
2002/0158497 A1 * 10/2002 Nivet et al. ..... 297/330

* cited by examiner

*Primary Examiner*—Rodney B White
(74) *Attorney, Agent, or Firm*—Arthur W. Fisher, III

(57) ABSTRACT

A positioning and control system to selectively position and to monitor and record the position of the seat frame, back rest frame and leg rest supports of a powered wheelchair wherein the positioning and control system comprises a seat positioning mechanism including a seat tilt positioning assembly and a back rest recline positioning assembly to position the tilt of the seat frame and the recline of the back rest frame respectively, and a leg rest positioning mechanism including leg rest positioning assemblies to position the leg rest supports, and a system control including an operator input control and a microprocessor to control, monitor and record the position of the seat frame, back rest frame and the leg rest supports.

13 Claims, 10 Drawing Sheets

SEAT POSITIONING AND CONTROL SYSTEM

BACKGROUND OF THE INVENTION

1. Field of the Invention

A positioning and control system to selectively position and to monitor and record the seat frame, back rest frame and leg rest supports a powered wheelchair.

2. Description of the Prior Art

When a wheelchair occupant sits in the same position in a wheelchair for an extended period of time the weight of the buttocks, legs, and/or back reduce blood circulation that can result in ulcers or other medical problems. Therefore, the occupant of a wheelchair may need to shift weight over time. Normally, this is accomplished by tilting the seat portion or reclining the back rest and/or leg rests to the wheelchair so that the occupant's weight is shifted away from the pressure points on the his or her body.

U.S. Pat. No. 6,409,265 relates to a wheelchair comprising a seat frame mounted to ae base and a seat frame tilting mechanism for rotating the seat frame with respect to the base. A back frame can be reclined with respect to the base by a back frame recline mechanism is positioned for rotating the back frame with respect to the base. A controller is provided for separately controlling the seat frame tilting mechanism and back frame recline mechanism so that the seat frame and the back frame can be rotated independently.

U.S. Pat. No. 6,032,976 teaches a wheelchair with a tiltable seat comprising a base frame, a seat frame, a plurality of pivotable side connection members and at least one drive member. The seat frame is tiltable relative to the base frame. The drive member is attached to a longitudinally movable support member and is capable of moving the longitudinally movable support member forward and backward.

U.S. Pat. No. 6,450,581 discloses a wheelchair has a seat frame, leg rests pivotally mounted for elevation with respect to the seat frame and an elevation mechanism. The elevation mechanism includes a latch link having a leg rest end attached to the leg rest and a pivot end. Also included is a pivot link having a frame end pivotally connected to the seat frame with a latch link end pivotally connected to the pivot end of the latch link. The latch link end of the pivot link and the pivot end of the latch link are pivotally connected through a latch pin. An actuator including a piston movable in forward and rearward direction with respect to the seat frame to pivots the leg rests relative to the seat frame.

U.S. Pat. No. 6,030,351 shows A pressure relief reminder and compliance system comprising a sensor which responds according to pressure exerted on the skin; a programmable microcontroller connected to the sensor; means for programming the microcontroller; and indicating means. A programming device operates software to changeably program the microcontroller with certain values of pressure and time such that the level and duration of pressure on the skin and the duration of the absence of pressure thereon are compared to the programmed values, is given to the wheelchair user, and the levels and duration of pressure are stored in memory. The programming device also can download from the memory-the recorded values for review and analysis by a physician, clinician, therapist or other health professional. The indicators can be an audible alarm, like a beeper or buzzer, or a vibrator.

U.S. Pat. No. 6,014,346 describes a portable electronic device for timing and monitoring patient sedentary inactivity. A timer measures an interval of time having a predetermined duration representative of sedentary position of a patient to notify a health care provider of the need to perform a medical treatment upon completion of measurement of the interval of time. A patient position sensor is configured to detect a sedentary patient condition.

SUMMARY OF THE INVENTION

The present invention relates to a positioning and control system to selectively position and to monitor and record the position of the seat frame, back rest frame and leg rest supports of a powered wheelchair. The positioning and control system comprises a seat positioning mechanism including a seat tilt positioning assembly and a back rest recline positioning assembly to position the tilt of the seat frame and the recline of the back rest frame respectively, arid a leg rest positioning mechanism including leg rest positioning assemblies to position the leg rest supports. A system control to control the operation of positioning mechanism includes an operator input control and a microprocessor to control, monitor and record the position of the seat frame, back rest frame and the leg rest supports.

The microprocessor controls a plurality of drive output channels independently or in groups as well as controls the speed and direction of each positioning mechanism by controlling the state of a reversing contactor for each drive output channel. Speed input channels interface potentiometers or the like with the microprocessor to individually set a maximum speed setting for each drive output channel. The drive input channels interface with the microprocessor through input devices, such as toggle switches and pushbuttons. Such input devices may be configured for control or operation by the person in the wheelchair and an attendant.

Indicator output channels interface the microprocessor to output devices such as indicator lights, audible signaling devices, LEDs and powered wheelchair drive lock-out signals. Sensor input channels interface tip-switches, limit switches, powered wheelchair override signals with the microprocessor to limit the travel tilt and recline and to generate a drive lock-out signal.

The microprocessor controls the drive lock-out signal to limit the speed or fully inhibit the locomotion drive capability of the powered wheelchair depending on the configuration.

The microprocessor employs sensor input channel data to selectively control the direction of the drive output channels to establish limits of travel for each positioning mechanism.

Configuration input channel data associated with drive input channels can be configured to control a group mapping of one or multiple drive output channels to be driven in response to each drive input channel. A drive output channel can be a member of more than one group. When multiple drive output channels are to be synchronized or operated together in response to a single drive input channel signal the configuration input channel data also determines the appropriate direction of the actuators so that a desired compound seat motion is results. Each group has a speed factor and direction bias for each drive output channel in that group.

In addition, the microprocessor can be made capable of monitoring and recording seat activity information into memory data that is retrievable and can be reinitialized by an external device such as a printer, computer or smart memory card, through one of the communication channels. For example, seat configuration input data, time stamps and durations for, but not limited to, the following activities:

controller power on, person detected in the powered wheelchair, seat in prescribed tilt position and seat tilted beyond drive lock-out position.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
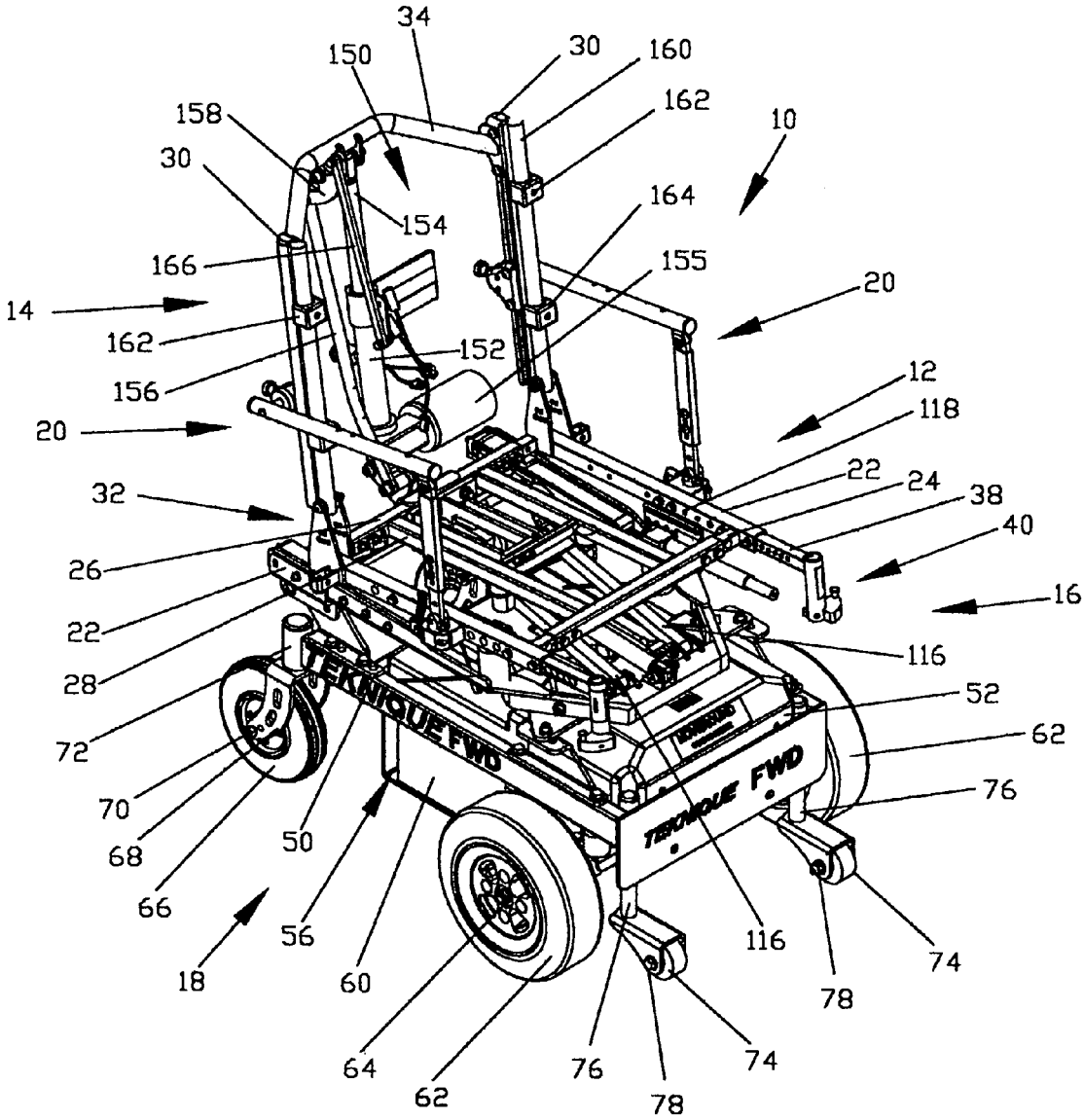
FIG. 1 is a front perspective view of a powered wheelchair frame incorporating the positioning and control system of the present invention.
Figure 3:
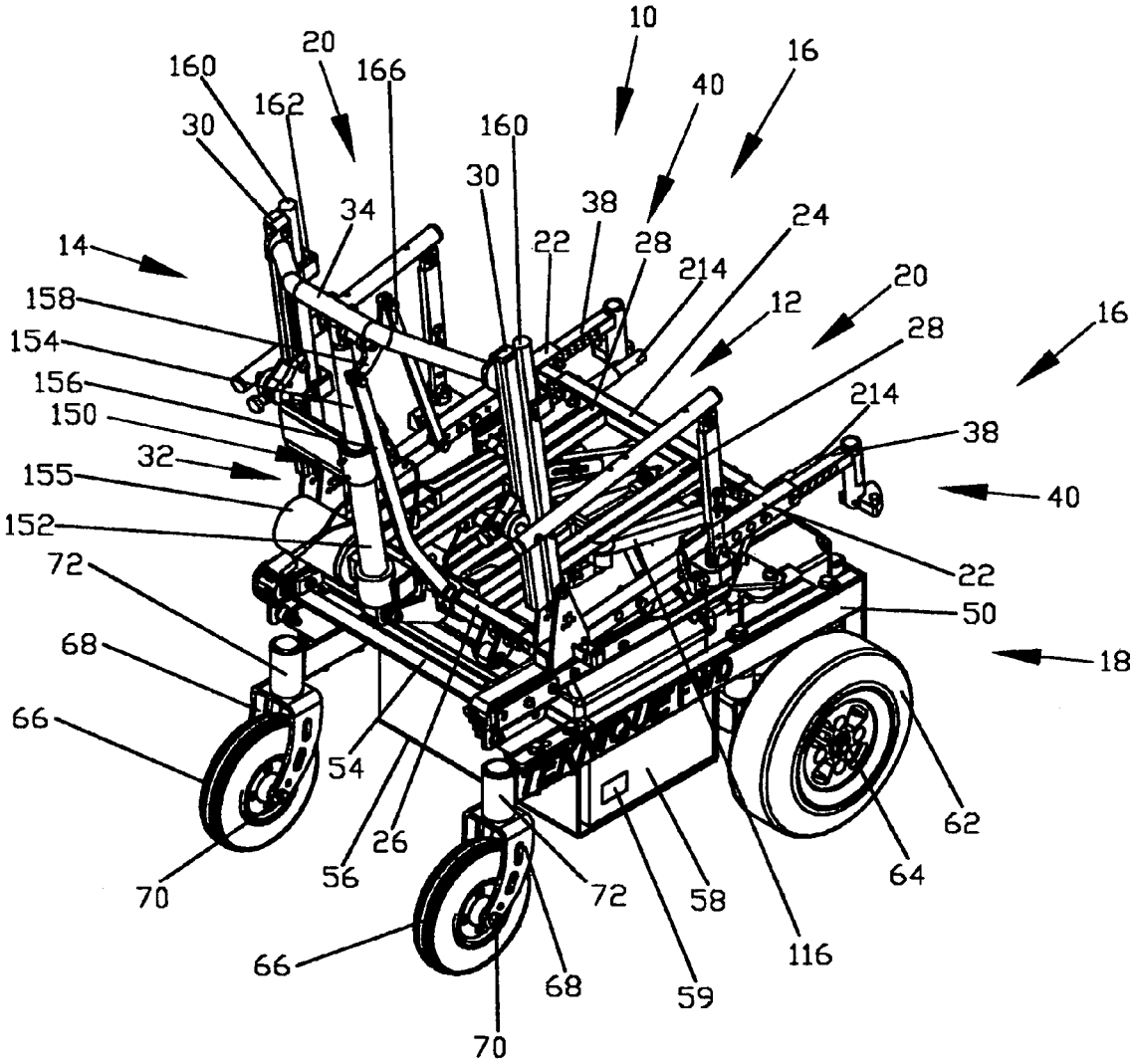
FIG. 3 is a rear perspective view of a powered wheelchair frame incorporating the positioning and control system of the present invention.

The present invention relates to a positioning and control system to selectively position and to monitor and record the position of a seat frame, back rest frame and leg rest supports of a powered wheelchair generally indicated as 10 in FIGS. 1 and 3. The positioning and control system comprises a seat positioning mechanism including a seat tilt positioning assembly and a back rest recline positioning assembly to position the tilt of the seat frame and the recline of the back rest frame respectively, and a leg rest positioning mechanism including leg rest positioning assemblies to position the leg rest supports, and a system control including an operator input control and a microprocessor to control, monitor and record the position of the seat frame, back rest frame and the leg rest supports.

As shown in FIGS. 1 through 4, the powered wheelchair 10 comprises the seat frame generally indicated as 12, the back rest frame generally indicated as 14 and the leg rest supports each generally indicated as 16 mounted on a carriage assembly generally indicated as 18 An arm rest support generally indicated as 20 is attached to the seat frame 12 and back rest frame 14 on opposite sides of the powered wheelchair 10.

The seat frame 12, the back rest frame 14, the arm rest supports 20 and the leg rest supports 16 are configured to support cushions or the like (not shown).

Figure 2:
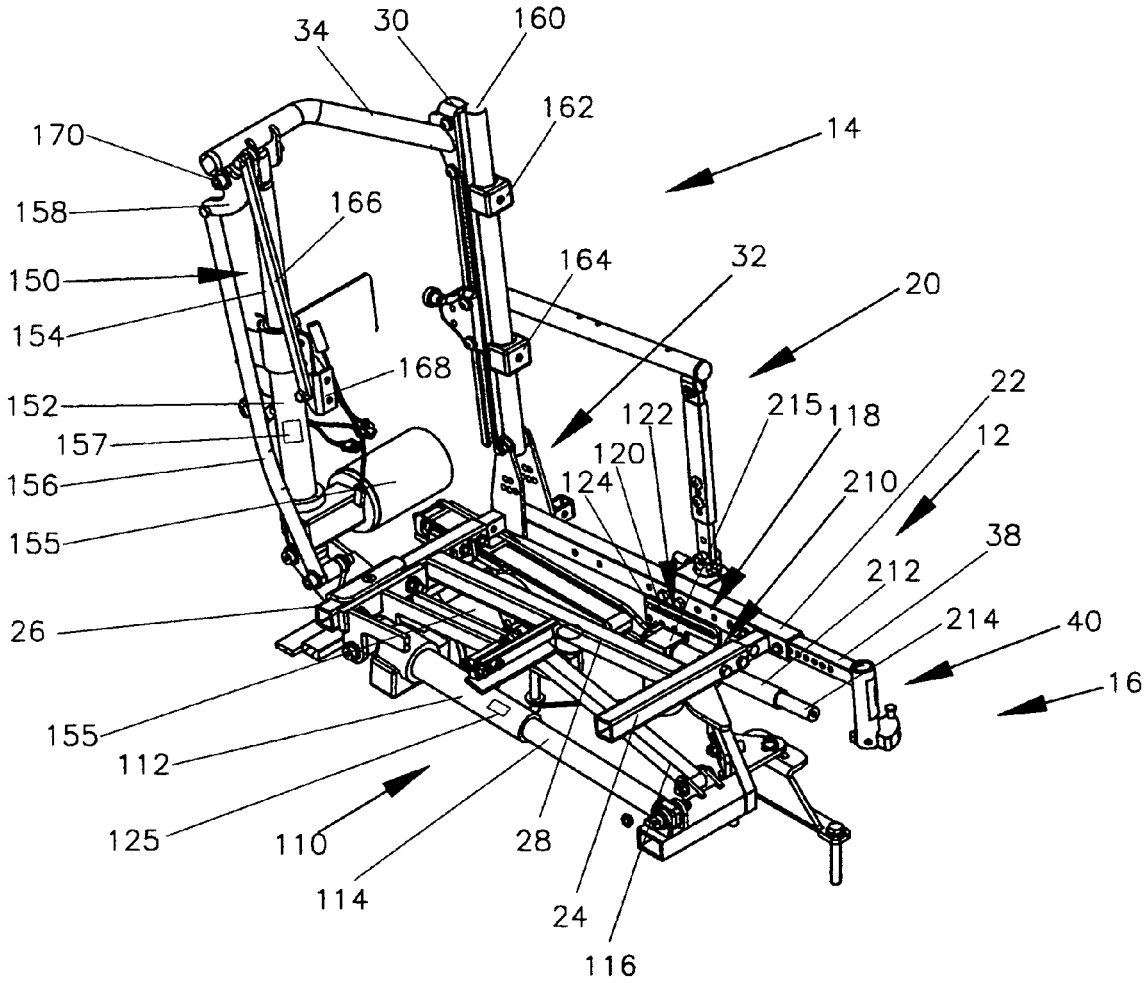
FIG. 2 is a partial front perspective of a powered wheelchair frame incorporating the positioning and control system of the present invention.

As shown in FIGS. 1 through 3, the seat frame 12 comprises a pair of side seat frame members each indicated as 22 held in fixed spaced relationship relative to each other by a front seat frame member and a rear seat frame member indicated as 24 and 26 respectively, and a pair of intermediate seat frame members each indicated as 28. The seat frame 12 is pivotally coupled to the carriage assembly 18 at pivot 29.

As shown in FIGS. 1 through 3, the back rest frame 14 comprises a pair side back rest frame members each indicated as 30 pivotally coupled to corresponding side seat frame members 22 of the seat frame 12 by a corresponding pair of brackets and corresponding pivot member generally indicated as 32 held in fixed spaced relationship by an upper back rest frame member 34.

Figure 4:
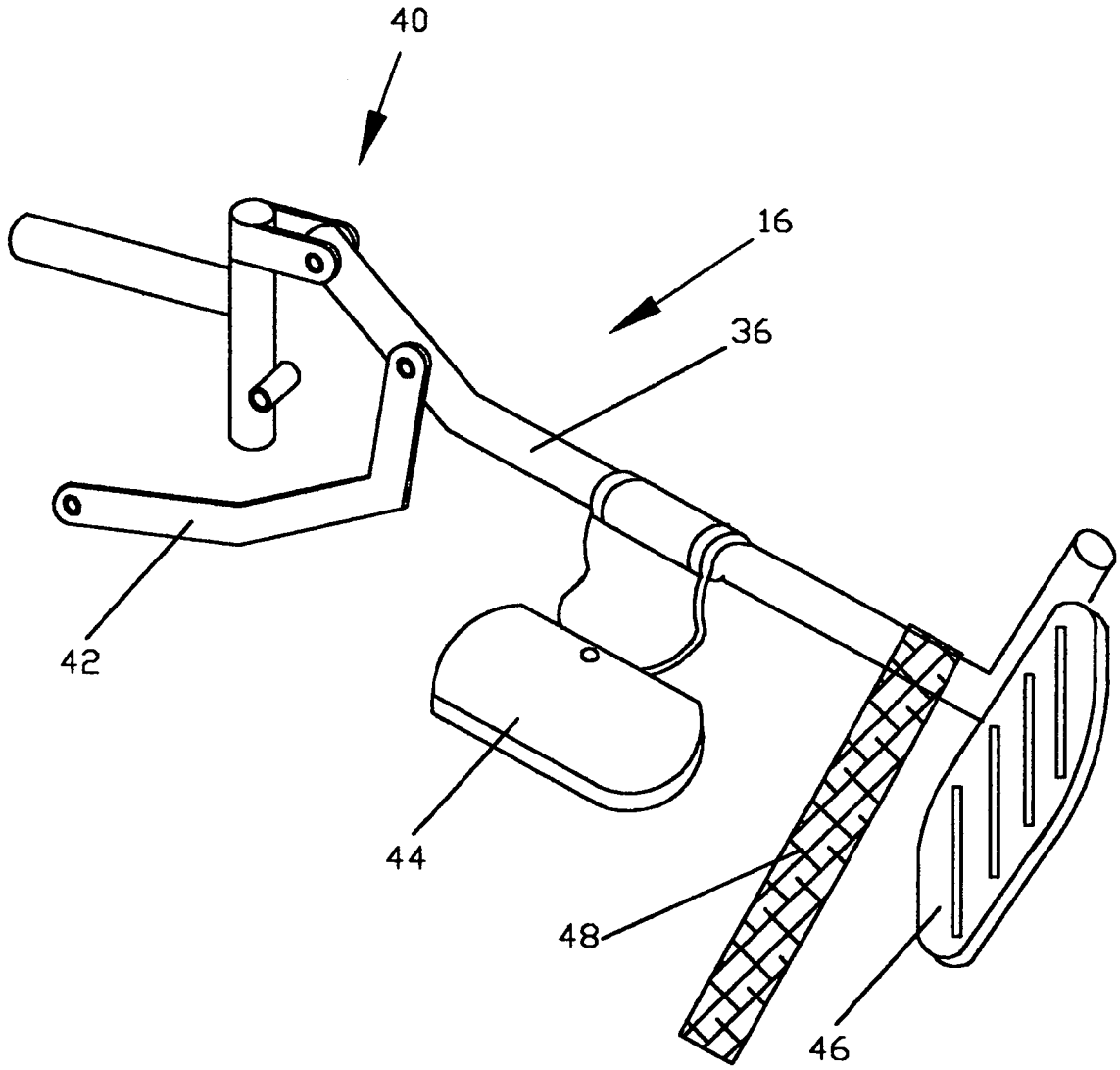
FIG. 4 is a perspective view of a leg rest of the positioning and control system of the present invention.
Figure 5:
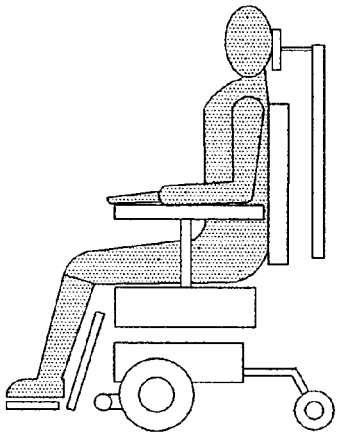
FIG. 5 is a schematic side view of a powered wheelchair frame in a substantially upright position.
Figure 6:
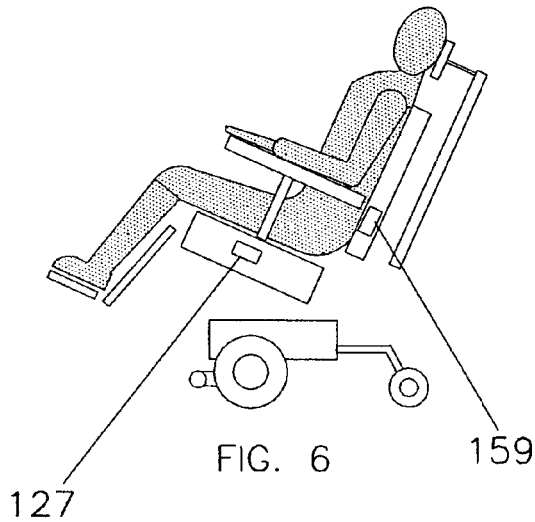
FIG. 6 is a schematic side view of a powered wheelchair frame in a partial tilt position.
Figure 7:
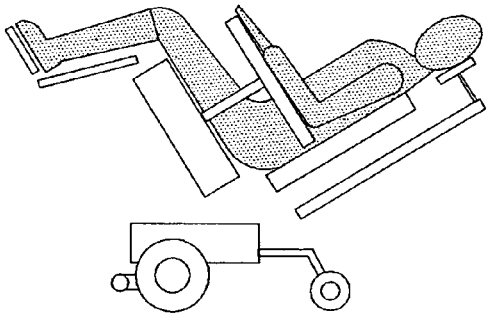
FIG. 7 is a schematic side view of a powered wheelchair frame in a substantially full tilt position.
Figure 8:
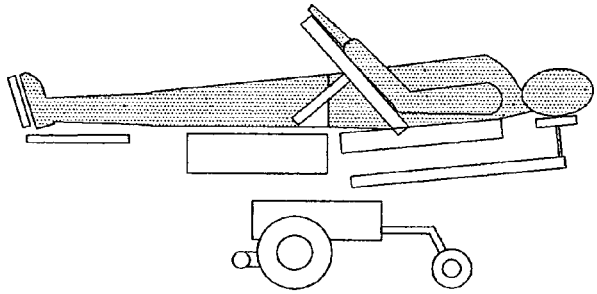
FIG. 8 is a schematic side view of a powered wheelchair frame in a substantially full recline position.

As best shown in FIG. 4, each leg rest support 16 comprises a leg rest member 36 pivotally coupled to a corresponding leg rest extension 38 attached to a corresponding side seat frame member 22 by a corresponding leg rest mounting bracket and pivot member generally indicated as 40, and a leg rest member linkage 42 connected to the seat frame 12. As shown, a leg rest cushion 44 and a foot rest 46 with restraining band or element 48 are operatively attached to each leg rest member 36 of each leg rest support 16.

As shown in FIGS. 1 and 3, the carriage assembly 18 comprises a carriage frame including a pair of side carriage frame members each indicated as 50 held in fixed spaced relationship relative to each other by a front carriage frame member and rear carriage frame member indicated as 52 and 54 respectively having a carriage compartment 56 mounted on the carriage frame to operatively receive and support a portion of the system control 58, a wheelchair drive means such as an electric motor (not shown) and a power source 60 such as a DC storage battery. The carriage assembly 18 is supported on the ground, floor or other support surface by a front carriage support and a rear carriage support coupled to the front and rear portions of the carriage frame respectively.

As shown in FIGS. 1 and 3, the front carriage support comprises a front wheel drive assembly including a drive wheel 62 mounted on opposite sides of the front portion of the carriage frame by a transverse dual axle 64 or similar axle configuration operatively coupled to the wheelchair drive means (not shown) to power the powered wheelchair 10 over the supporting surface in response to drive control signals from the system control 58 in accordance with control commands from the occupant. The wheelchair drive means (not shown) and the power source 40 are similar in operation to those generally known in the art. The rear carriage support comprises a rear wheel swivel assembly including a wheel 66 rotatably mounted to a swivel bracket 68 by a member or axle 70 that is, in turn, rotatably mounted to the corresponding carriage side frame member 50 by a swivel mount 72.

As shown in FIG. 1, an anti-tip, anti-scuff assembly is mounted to the forward portion of the carriage assembly 18. Specifically the anti-tip, anti-scuff assembly comprises a wheel or roller 74 mounted on opposite sides of the front carriage frame member 52 or the front portions of the carriage side frame members 50 by a correspondingly mounting member 76. As shown, each wheel or roller 74 is rotatably coupled to the corresponding mounting member 76 by a mounting pin or axle 78.

As shown in FIGS. 1 through 3, the seat tilt positioning assembly comprises a tilt actuator generally indicated as 110 such as an electrically powered linear actuator or similar device including an actuator sleeve 112 pivotally coupled to the seat frame 12 and a tilt shaft or actuator member 114 reciprocally disposed therein and movable between a retracted position and an extended position by a tilt motor 115 pivotally coupled to the front carriage frame member 52 of the carriage frame, a pair of tilt link or seat frame positioning members each indicated as 116 pivotally coupled at opposite end portions thereof to the seat frame 12 of the front carriage frame member 52 of the carriage frame and a seat frame slide assembly generally indicated as 118 on opposite sides of the seat frame 12 and the carriage assembly 18 including a guide plate 120 having an elongated slot 122 formed therethrough affixed to opposite side portions of the seat side frame member 22 of the seat frame 12 to receive a corresponding pivot protrusions or pins 124 on the carriage frame. The position of the seat relative to the carriage at any time can be determined by a position sensor 125 or the start and stop time of the tilt motor 115, the original or start position of the linear actuator and direction of travel. The microprocessor 59, having recorded the stop position, receiving a command signal from the input control for the direction of travel and recording the run time of the tilt motor 115, calculates the distance of travel to determine the new seat position.

Alternately, a pressure sensor 127 can be placed in the seat.

To tilt the seat frame 12, the tilt actuator 110 is operated to either extend or retract the tilt shaft or actuator member 114 relative to the tilt actuator sleeve 112 to either push or pull the seat frame 12 rearward or forward relative to the carriage assembly 18 along the seat frame slide assemblies 118 such that the tilt link or seat frame positioning members 116 either rotate the seat frame 12 down or up relative to the carriage assembly 18 about the pivots 29.

As shown in FIGS. 1 through 3, the back rest recline positioning assembly comprises a recline actuator generally indicated as 150 such as an electrically powered linear actuator or similar device including an actuator sleeve 152 pivotally coupled to the carriage frame and a recline shaft or actuator member 154 reciprocally disposed therein and movable between a retracted and an extended position by a recline motor 155 pivotally coupled to the upper back rest frame member 34 of the back rest frame 14, a recline link or back rest frame position member 156 pivotally coupled at opposite end portions to the seat frame 12 and to the upper back rest frame member 34 by a coupling member 158. To change the recline position of back rest frame 14, the recline actuator 150 is operated to either extend or retract the recline shaft or actuator member 154 relative to the recline actuator sleeve 152 to either push or pull the recline link or back rest frame position member 156 and coupling member 158 to rotate the back rest frame 14 relative to the seat frame 12 about the pivots 32 to raise or lower the back rest frame 14. The position of the back rest relative to the carriage at any time can be determined by a position sensor 157 or, the start and stop time of the recline motor 155, the original position of the linear actuator and direction of travel. The microprocessor 59, having recorded the stop position, receiving a command signal from the input control for the direction of travel and recording the run time of the recline motor 155, calculates the distance of travel to determine the new back rest position.

Alternately, a pressure sensor 159 can be placed in the back rest.

As shown in FIGS. 1 through 3, the back rest recline positioning assembly further comprises a back rest shear reduction assembly to reduce the shear forces exerted on the occupant of the powered wheelchair 10 during movement of the back rest frame 14 relative to seat frame 12. The back rest shear reduction assembly comprises a slide member 160 affixed to each side back frame member 30 to operatively support in sliding engagement an upper and lower back cushion slide attachment or mount indicated as 162 and 164 respectively to support a back rest cushion (not shown) and a shear reduction link or back rest cushion positioning member 166 pivotally coupled at opposite end portions thereof to the upper back rest frame member 34 and the back rest cushion (not shown) by the coupling member 158 and a back rest attachment 168 respectively. As the recline shaft or actuator member 154 is either extended or retracted the coupling member 158 pivots about pivot 170 pulling or pushing the shear reduction link or back rest cushion positioning member 166 and the back rest attachment 168 moving the upper back cushion slide attachment or mount 162 and 164 with the back rest cushion (not shown) up or down the corresponding slide 16 in mechanical synchronization with the movement of the back rest frame 14.

As shown in FIGS. 1 through 4, each leg rest positioning assembly 16 comprises a leg rest actuator generally indicated as 210 such as electrically powered linear actuator or similar device including an actuator sleeve 212 coupled to the seat frame 12 and a leg rest shaft or actuator member 214 reciprocally disposed therein and movable between a retracted and an extended position by a leg rest motor 215 pivotally to the leg rest member 36 by the leg rest member linkage 42. To raise or lower either leg rest support 16 relative to the seat frame 12, the corresponding leg rest actuator 210 is operated to either extend or retract the leg rest shaft or actuator member 214 relative to the leg rest sleeve 212 to either push or pull the corresponding leg support 36 to pivot the leg rest member 36 about pivots 216 and 218 to raise or lower the corresponding leg rest support 16.

The positioning and repositioning of the seat tilt positioning assembly, the back rest recline positioning assembly and the leg rest positioning assemblies relative to the carriage assembly 18 and to each other cooperatively act as a pressure relief seating system by selectively shifting the occupant's weight by positioning of the occupant's body and limbs to rest in the powered wheelchair 10 as shown in FIGS. 5 through 8.

Figure 13:
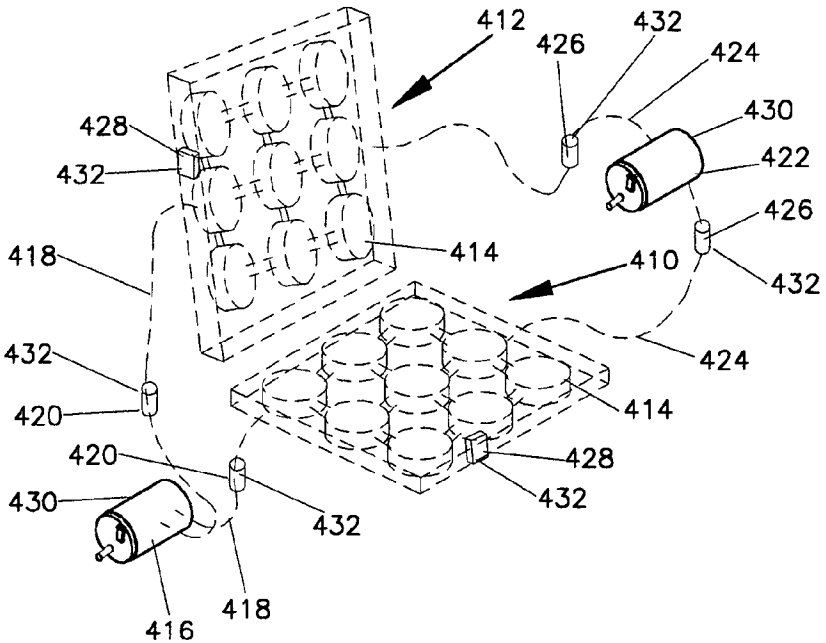
FIG. 13 shows a detailed view of the alternate embodiment of the pressure relief seating system of the positioning and control system of the present invention.
Figure 12:
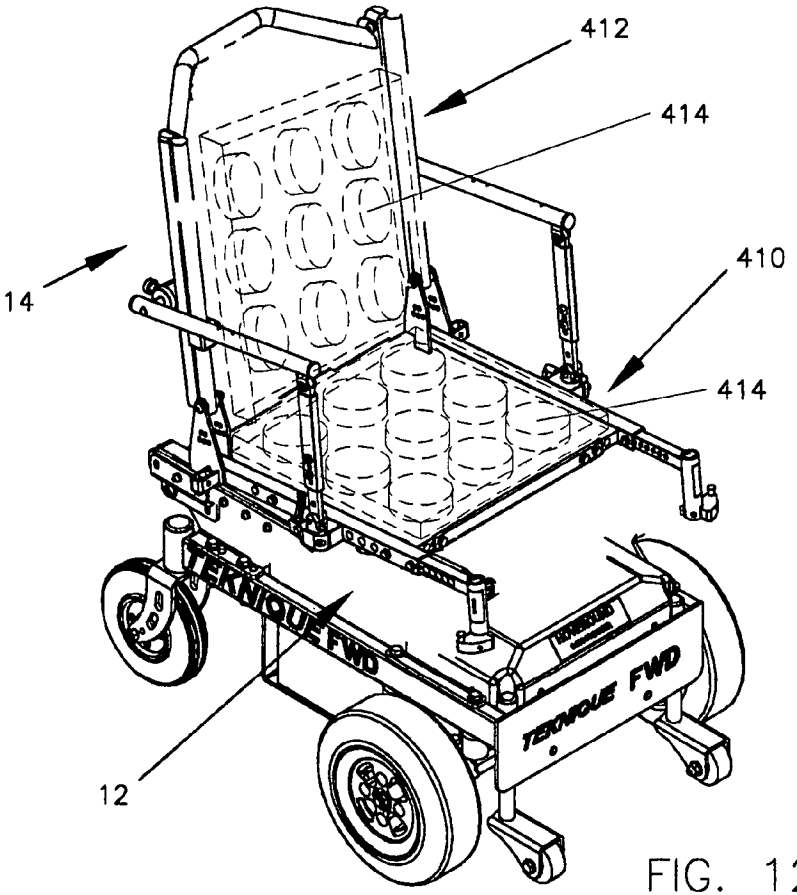
FIG. 12 shows a partial view of an alternate embodiment of the pressure relief seating system of the positioning and control system of the present invention.

FIGS. 12 and 13 show an alternate embodiment of the pressure relief seating system comprising a pneumatic seat support generally indicated as 410 and a pneumatic back support generally indicated as 412 operatively disposed on the seat frame 12 and the back rest frame 14 respectively. The pneumatic seat support 410 and the pneumatic back support 412 each comprises at least one air or pneumatic cell 414 coupled to an air supply 416 such as an air pump by an air supply conduit 418 through an air supply flow control or valve 420 and to a vacuum 422 by an air discharge conduit 424 through an air discharge flow control on valve 426. As pressure sensor 428 is operatively disposed relative to each pneumatic seat support 410 and the pneumatic back support 412 to sense the pressure within each pneumatic cell 414 and to generate a pressure signal in response to the pressure within each pneumatic cell 414. The air supply 416 and the air vacuum 414 are connected to the power source 60 by conductors 430. The air supply flow control valve 420, the air discharge flow control or valve 426 and the pressure sensors 428 are connected to the microprocessor 59 by corresponding conductors 432 to send and receive control and feedback signals between the pressure relief seating system and the system control.

The microprocessor 59 can be programmed to control the operating parameters such as the sequencing, inflation duration or period and inflation pressures for the pneumatic cells 414 of the pneumatic seat support 410 and the pneumatic back rest support 412. Of course, the operating parameters of the pressure relief seating system can be controlled by the joy stick 110 or the push button switch 112 configured to generate control input signals to the microprocessor 59. Audio and/or visual alarms 432 may be provided to generate a warning when the selected pressure(s) are not within a preselected range(s) of the selected pressure value(s).

In operation, the air supply 416 generates the appropriate air pressure, which is monitored by the pressure sensors 428. The airflow control valve 426 and the vacuum 430 are used to deflate the selected air cells 414. The microprocessor 59 control the control valves 420 to inflate and deflate the corresponding air cells 414. The inflation cycle is controlled by either the occupant or microprocessor 59.

The system control comprises an operation input selector to select the modes of operation and a system controller including a microprocessor or control processor 59. The positioning and control system is selectively operable in a drive motor lock-out mode to prevent locomotion or movement of the powered wheelchair 10 over the ground or supporting surface when the included angle between the back rest frame 14 and the ground or supporting surface is less than a predetermined value such as 15 degrees and a tilt/recline lock-out mode to prevent operation of the tilt motor 115 and the recline motor 155 when the angle between the back rest frame 14 and the carriage frame is less than a predetermined value such as 5 degrees. The drive motor lock-out and tilt/recline lock-out include a first and second back rest frame sensor indicated as 310 and 312 respectively such as a mercury switch, potentiometer or other similar device attached to the back rest frame 14. Both the first back rest frame sensor 30 and the second back rest frame sensor 312 are coupled to the control processor to send position signals thereto when the corresponding inclined angles are equal to or less than the predetermined values such that the system control 58 disables the wheelchair drive means (not shown) and the tilt motor 115 respectively.

The positioning and control system is also selectively operable in a normal or direct mode and an auto-reversing mode.

As previously described, the present invention has a plurality of positioning functions. Specifically, the positioning functions include tilt, recline, leg rest elevation and recline/leg rest elevation.

The tilt function causes the entire seat frame 12, the backrest frame 14, and the arm rest supports 20 to rotate or pivot together. The center of gravity is adjusted to shift the weight by sliding the pivot axis and entire seat assembly forward as the seat tilts back.

The recline function rotates or pivots the back rest frame 14 relative to the seat frame 12.

The leg rest supports 16 can be activated in three configurations: the leg rest supports 16 elevate in unison or are synchronized keeping the right and left legs at the same height, the leg rest supports 16 elevate in conjunction with the recline function of the back rest frame 14, and the leg rest supports 16 elevate separately to position the right and left legs at different heights independently of each other and the back rest frame 14 position.

In addition, back shear is reduced when reclining to reduce the shear movement between the occupant and the backrest. This is accomplished through the linkage that slides the backrest cushion (not shown) on the backrest frame 14 as previously described.

Figure 9:
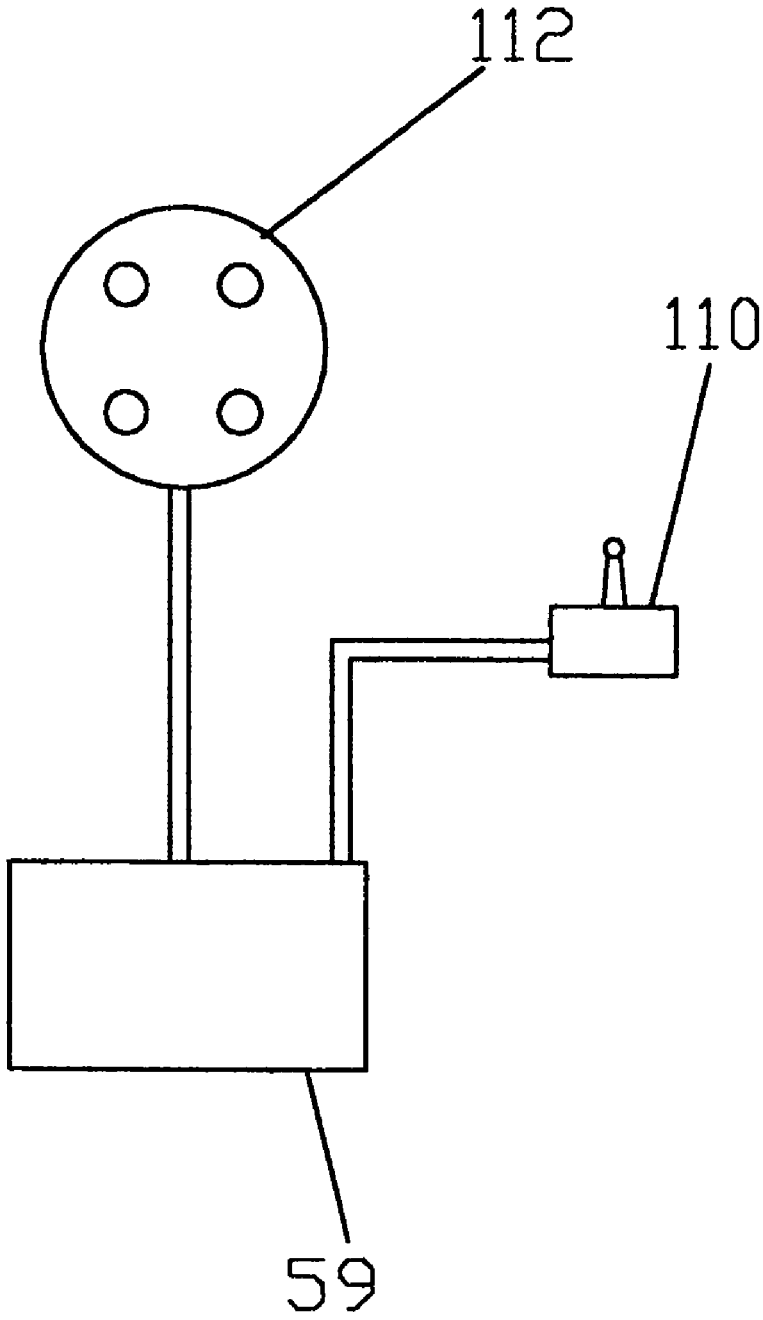
FIG. 9 shows a dual operator control for the positioning and control system of the present invention.

The microprocessor 59 allows the occupant and/or attendant to operate the system in either a "Normal" mode or an "Auto-Reversing" mode. As shown in FIG. 9, the control or operator input to positioning and control system of the present invention can be accomplished by a joy stick or toggle 110 or a plurality of push button switch generally indicated as 112 coupled to the microprocessor 59 to feed control signals thereto.

For example, when in the:

Normal Mode Pulling the toggle back will cause the seat to tilt back. Pushing the toggle forward will cause the seat to tilt forward.

Auto-Reversing Mode Pushing the toggle forward will cause the seat to tilt back. Releasing the toggle to its rest position, pausing, and pushing the toggle forward again, will cause the seat to tilt forward.

Push Butt n Switches The push button switches come in singles, and sets of two and four. To activate the function simply hold the button down. The motion will stop when the button is released. Two buttons are required for each function in "Normal" mode, and one button is required for each function in "Auto-Reversing" mode.

Figure 10:
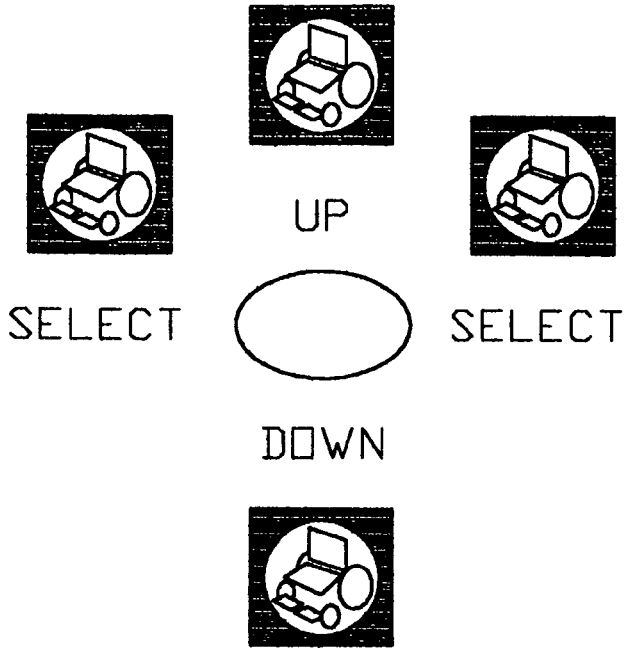
FIG. 10 illustrates operation of a joystick of the positioning and control system of the present invention.

As shown in FIG. 10, all seat adjustment can be controlled by the joystick 110 thereby minimizing the user operations needed for precise positioning of the seat. Left or right movements of the joystick select different actuators, and forward and reverse movements actually move the seat. In total six adjustments are possible—both footrests, right footrest, left footrest, tilt in space, recline and recline/leg rests.

Figure 11:
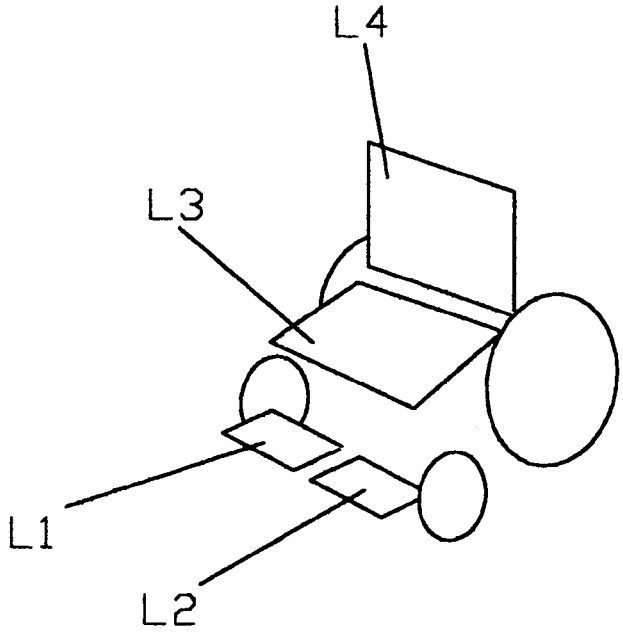
FIG. 11 illustrates LED indicators for the positioning functions of the positioning and control system of the present invention.

As shown in FIG. 11, shows the various selector positioning functions through the use of LEDs.

Tilt adjusts the position of the seat frame 12 and back LED 3 and LED 4 rest frame 14 back in unison Recline adjusts the angle of the back rest frame 14 LED 4

Left leg rest elevates the left leg rest LED 2

Right leg rest elevates the right leg rest LED 1

Dual leg rest (noted by lit left and right footplates) LED 1 and LED 2

Recline and dual leg rest in unison LED 1, LED 2 and LED 4

To return to standard drive selection mode, press the mode selection key.

Figure 14:
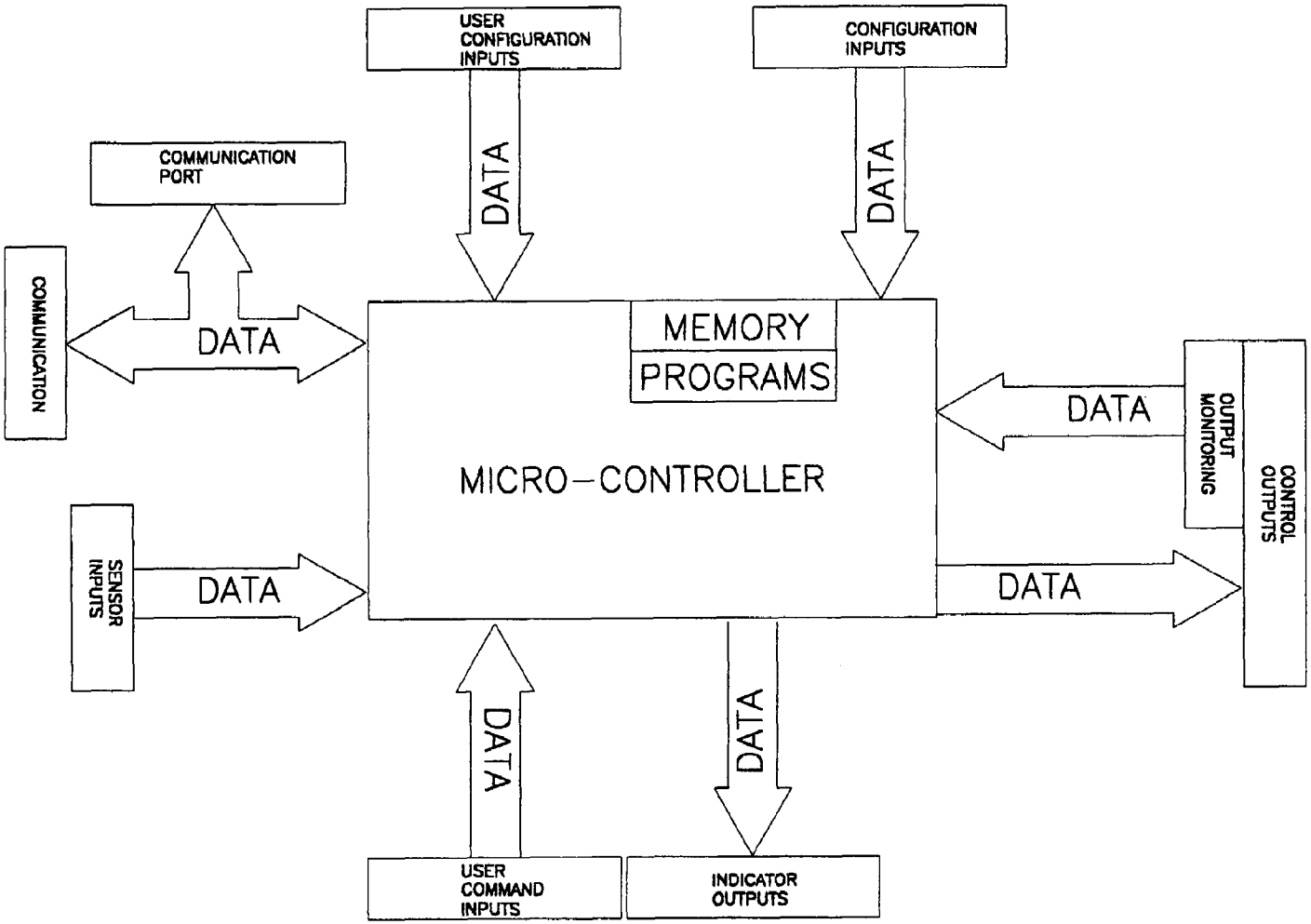
FIG. 14 is a diagram of the data exchange between the electro-mechanical components of the positioning and control system and the system control including the microprocessor or microcontroller of the present invention.

FIG. 14 shows the data transfer and feedback information for the operation of the powered wheelchair 10, the microprocessor 59 and the system control.

Specifically, the microprocessor 59 controls a plurality of drive output channels independently or in groups as well as controls the speed and direction of each positioning mechanism by controlling the state of a reversing contactor for each drive output channel. Speed input channels interface potentiometers or the like with the microprocessor to individually set a maximum speed setting for each drive output channel. The drive input channels interface with the microprocessor through input devices, such as toggle switches and pushbuttons. Such input devices may be configured for control or operation by the person in the wheelchair and an attendant.

Indicator output channels interface the microprocessor to output devices such as indicator lights, audible signaling devices, LEDs and powered wheelchair drive lock-out signals. Sensor input channels interface tip-switches, limit switches, linear actuator position sensors, powered wheelchair override signals with the microprocessor to limit the travel tilt and recline and to generate a drive lock-out signal.

Communication channels can interface the microprocessor with external programming and data retrieval devices such as RS232, Ethernet, or USB, and intergrate the seat control with the powered wheelchair control system such as Penny & Giles JBUS II or Dynamic Controls DX bus.

Configuration input channels are interfaced with the microprocessor by configuration inputs, such as dip switches, and jumpers to permit different settings that represent different configurations.

Configuration input channel data associated with corresponding sensor input channels control which sensor inputs are to be evaluated; while, a configuration input channel data associated with a drive lock-out signal to the powered wheelchair drive control system generates the drive lock-out signal.

The microprocessor 59 controls the drive lock-out signal to limit the speed or fully inhibit the locomotion drive capability of the powered wheelchair depending on the configuration. For instance, a person is reclined in the powered wheelchair may is not able to safely drive or control the powered wheelchair so the positioning and control system generates a signal to lock-out the drive. For example, a mercury type tilt sensor or similar sensor is used to sense a predetermined angle at which the powered wheelchair drive locknut occurs. Since this type of switch is dependent on gravity, the microprocessor is programmed to only generate powered wheelchair drive lock-out signal when the positioning of reclining or tilting positioning mechanism are active thereby eliminating false lock-out due to such things as the powered wheelchair is driven on an incline or over bumps.

The microprocessor 59 employs sensor input channel data to selectively control the direction of the drive output channels to establish limits of travel for each positioning mechanism. Again, a mercury type tilt sensor or similar sensor may be used to sense when a predetermined pitch angle of tilt and recline is sensed such that the drive output channels corresponding to recline actuator and tilt actuator are limited in the respective directions to limit the seat from exceeding the pitch angle.

Configuration input channel data associated with drive input channels can be configured to control a group mapping of one or multiple drive output channels to be driven in response to each drive input channel. A drive output channel can be a member of more than one group. When multiple drive output channels are to be synchronized or operated together in response to a single drive input channel signal the configuration input channel data also determines the appropriate direction of the actuators so that a desired compound seat motion is results. Each group has a speed factor and direction bias for each drive output channel in that group. For instance, a configuration grouping can include the left and right leg rest positioning mechanism with the recline positioning mechanism to respond to a single switch input. The directional bias would be instituted so that the leg rest supports would both extend as the seat back reclines and as the seat back inclines both leg rest supports would retract. A speed factor different from the speed of the leg rest positioning mechanism acting independent of the recline positoning mechanism can be set for the leg rest supports such that the leg rest positioning mechanism extend and retract at a comfortable speed relative to the recline speed or motion.

Configuration input channel data can determine the directional polarity of the corresponding drive out-put channel. The directional polarity of the drive output channel controls the extension or contraction of the corresponding positioning mechanism. In an auto-reversing mode, the direction polarity is controlled by the microprocessor 59. In this configuration, a first input request on a first drive input channel is received by the microprocessor 59. The microprocessor 59 uses a preprogrammed default direction as a first direction for the corresponding drive output channel. The microprocessor 59 stores the direction of motion in memory data for that channel indicating the direction of the last motion. When a second input request on that first drive input channel is received by the microprocessor 59, the microprocessor 59 uses the direction stored in memory for that channel that corresponds to the opposite direction stores in memory data for each drive output channel activated the opposite direction that motion to be used for the next activation. When the input request requires a group of multiple drive output channels to respond, the next direction of the group master is used and the other channels follow using the directional bias data. For example, legs may have been used prior in opposite directions individually. However, when the legs and recline are grouped, both legs follow the recline.

The auto-reversing can be disabled for some or all drive input channels. With auto-reversing disabled, one drive input channel determines a first direction for the corresponding drive output channel or group of drive output channels, and another drive input channel determines the opposite direction for the drive output channel or group of drive output channels. For example, auto-reversing can be disabled for pushbuttons provided for the person in the powered wheelchair; while, auto-reversing remains enabled for toggle switches provided for an attendant.

Another configuration allows drive input channel data to be read by the microprocessor 59 over a communication input channel for another control system such as a powered wheelchair drive control system. An example of such a powered wheelchair drive control system is the Penny & Giles Pilot+control system that utilizes a JBUS II bi-directional serial data protocol. Data packets are sent and received to communicate user interface commands to drive the positioning mechanism. Configuration input data determine if the data packet information is to be interpreted and used in an auto-reversing mode or in a direct control mode specified by the JBUS II protocol.

Figure 15:
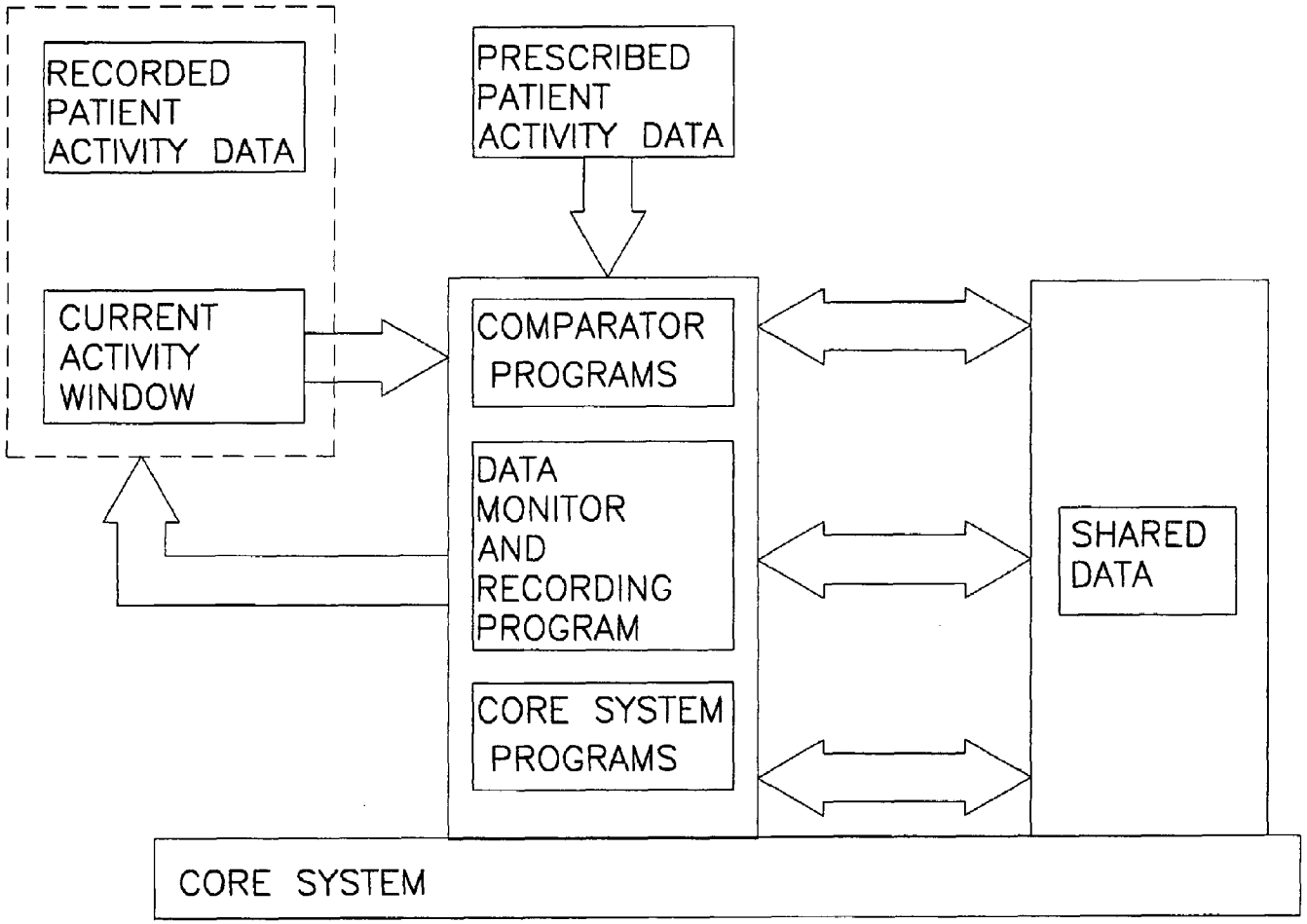
FIG. 15 is a diagram of the patient activity monitor and record function and memory structure of the present invention.

Patient activity can be monitored and recorded. The patient activity monitor and recording program and memory structure is illustrated in FIG. 15. In particular, the microprocessor 59 is capable of monitoring and recording seat activity information into memory data that is retrievable and can be reinitialized by an external device such as a printer, computer or smart memory card, through one of the communication channels. For example, seat configuration input data, time stamps and durations for, but not limited to, the following activites: controller power on, person detected in the powered wheelchair, seat in prescribed tilt position, seat tilted beyond drive lock-out position, seat tilted to end of travel position, seat tilt moving back, seat tilt stopped moving back, seat tilt moving forward, seat tilt stopped moving forward, seat recline moving down, seat recline stopped moving down, seat recline moving up, seat recline stopped moving up, right leg lift moving out, right leg lift stopped moving out, right leg lift moving in, left leg lift stopped moving in, left leg lift moving out, left leg lift stopped moving out, left leg lift moving in, left leg lift stopped moving in, drive lock-out on, and drive lock-out off.

In addition, the microprocessor 59 can monitor and record or log the seat pressure mapping of the pneumatic pressure relief seating system including pneumatic cell pressures, inflation periods and similar parameters.

The microprocessor 59 may log these seating events only when a person is detected in the chair. In addition, the microprocessor may be enabled such that the seating activity is compared to a prescribed activity regiment and issues a notification or alarm using available output channels or communication channels to signal a reminder or warning of a deviation from the prescribed activity regiment. Moreover, the microprocessor 59 can activate the various positioning mechanisms in a predetermined sequence to automatically change the position of the occupant's body and limbs without operator input.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A seating control system to selectively position and monitor the configuration of the seat and back rest of a powered wheelchair including a seat and a back rest adjustably supported on a carriage having a drive mechanism to power the powered wheelchair, said seating control system comprises a seat positioning mechanism and a back rest positioning mechanism to selectively position the seat and the back rest relative to the carriage and a system control including an input control and a microprocessor to control, monitor and record the position of the seat and the back rest relative to the carriage and to selectively retrieve the recorded seat configuration, said system control including a means to determine the position of the seat and to generate a seat position signal indicative of the position of the seat relative to the carriage and a means to determine the position of the back rest and to generate a back rest position signal indicative of the position of the back rest relative to the carriage and said seat position mechanism comprising an inflatable seat support and said back rest position mechanism comprises an inflatable back support coupled to an air pressure source to selectively inflate said inflatable seat support and said inflatable back support.

2. The seat control system of claim 1 wherein said means to determine the position of the seat is a pressure sensor operatively disposed relative to said inflatable seat support and said means to determine the position of the back rest is a pressure sensor operatively disposed relative to said inflatable back support to sense the pressure within said inflatable seat and said inflatable back support to generate corresponding signals in response to the pressures therein indicative of the position of said inflatable seat support and said inflatable back support respectively.

3. The seat control system of claim 2 further including an air vacuum operatively coupled to said inflatable seat support and said inflatable back support to selectively deflate said inflatable seat support and said inflatable back support.

4. The seat control system of claim 3 wherein said system control further includes an air supply flow control valve to selectively feed air to said inflatable seat support and said inflatable back support, a discharge flow control to selectively discharge air from said inflatable seat support and said inflatable back support valve in response to said pressure sensors connected to said microprocessor.

5. The seat control system of claim 1 wherein the seat configuration is recorded with respect to time.

6. The seat control system of claim 5 wherein the seat configuration is recorded with respect to duration.

7. The seat control system of claim 6 wherein the seat configuration is compared to a prescribed activity regiment and said system control generates an indication when the seat activity varies from said prescribed activity regiment.

8. The seat control system of claim 7 wherein said system control monitors and records the seat configuration when the powered wheelchair is occupied.

9. The seat control system of claim 1 wherein the position of the seat and back rest are recorded independently with respect to time.

10. The seat control system of claim 9 wherein the position of the seat and back rest are recorded independently with respect to duration.

11. The seat control system of claim 1 wherein said system control includes means to activate said seat and back rest positioning mechanisms in a predetermined pattern to the reposition of the occupant's body and limbs with respect to time.

12. The seat control system of claim 1 wherein the position of the seat and back rest are recorded independently with respect to time.

13. The seat control system of claim 12 wherein the position of the seat and back rest are recorded independently with respect to duration.

* * * * *